US010398191B2

(12) United States Patent
Cox

(10) Patent No.: US 10,398,191 B2
(45) Date of Patent: Sep. 3, 2019

(54) SKI BOOT ASSEMBLY

(71) Applicant: Carl Cox, Falls Church, VA (US)

(72) Inventor: Carl Cox, Falls Church, VA (US)

( * ) Notice: Subject to any disclaimer, the term of this patent is extended or adjusted under 35 U.S.C. 154(b) by 208 days.

(21) Appl. No.: 15/586,507

(22) Filed: May 4, 2017

(65) Prior Publication Data

US 2018/0317596 A1 Nov. 8, 2018

(51) Int. Cl.
*A43B 5/04* (2006.01)

(52) U.S. Cl.
CPC ..... *A43B 5/0409* (2013.01); *A43B 5/0427* (2013.01); *A43B 5/0464* (2013.01); *A43B 5/0486* (2013.01)

(58) Field of Classification Search
CPC ..... A43B 5/1641; A43B 5/18; A43B 5/0405; A43B 5/0409; A43B 5/0464; A43B 5/0466; A43B 5/0468; A43B 5/0476; A43B 5/0482; A43B 5/0427; A43B 5/0452; A43B 5/047; A43B 5/0486; A43B 5/0419; A43B 5/0421; A43B 3/24; A43B 3/242; A43B 3/16; A43B 3/18; A43B 23/10; A43B 23/105; A43B 23/088; A43B 23/16; A43C 11/146; A43C 11/1493
USPC ... 36/117.5, 117.6, 117.8, 118.2, 118.9, 119, 36/50.5
See application file for complete search history.

(56) References Cited

U.S. PATENT DOCUMENTS 522,371 A * 7/1894 Horn et al. ..... A43B 7/20 36/89
737,959 A * 9/1903 Posner ..... A43B 7/20 36/89
1,236,714 A 8/1917 Hoppe
1,465,180 A * 8/1923 Rowe ..... A43B 3/18 24/301
1,524,805 A * 2/1925 Clay ..... A43B 3/18 36/58.6
1,548,172 A * 8/1925 Redden ..... A43B 7/20 36/53

(Continued)

FOREIGN PATENT DOCUMENTS

DE 827761 C * 1/1952 ..... A43B 5/0486
EP 0162039 A1 11/1985

(Continued)

OTHER PUBLICATIONS

Translation of DE827761, Hans, Hans, Jan. 14, 1952, translated via Espacenet on Mar. 5, 2019 (Year: 1952).*

*Primary Examiner* — Jameson D Collier
*Assistant Examiner* — Heather N Mangine
(74) *Attorney, Agent, or Firm* — Capitol City TechLaw

(57) ABSTRACT

A ski boot assembly may include an outer shell having a relatively hard portion and a relatively soft portion. A cuff may be attached to the hard portion for pivot action relative to the outer shell. The cuff may extend around the outer shell, leaving an instep cover of the soft portion exposed. The cuff may include overlapping portions that are hinge coupled to the cuff. A flex bar may be inserted into a shaft of the hard portion. A bootboard may be situated above the sole plate, and be provided with ridges. A shoe can be inserted into the outer shell. The sole of the shoe may be provided with grooves that receive the ridges of the bootboard. A locking mechanism can be mounted on the hard portion of the outer shell to selectively engage with the heel of the shoe.

17 Claims, 15 Drawing Sheets

(56) References Cited

U.S. PATENT DOCUMENTS 3,313,046 A 4/1967 Werner et al.
3,374,561 A * 3/1968 Werner ..... A43B 5/0407 36/117.6
3,410,006 A 11/1968 Vogel
3,530,595 A * 9/1970 Vogel ..... A43B 5/04 36/117.6
3,597,862 A * 8/1971 Vogel ..... A43B 5/04 36/117.1
3,619,914 A 11/1971 Hanson et al.
3,645,017 A * 2/1972 Hickmann ..... A43B 5/0427 36/117.4
3,686,778 A 8/1972 Hornung
3,735,508 A 5/1973 Gertsch et al.
3,747,235 A 7/1973 Post
3,810,318 A * 5/1974 Epstein ..... A43B 5/00 36/105
3,870,325 A 3/1975 Davis
4,006,543 A 2/1977 Post
4,078,322 A * 3/1978 Dalebout ..... A43B 5/04 36/10
4,184,273 A * 1/1980 Boyer ..... A43B 3/02 36/118.2
4,246,708 A 1/1981 Gladek
4,267,650 A * 5/1981 Bauer ..... A43B 13/36 36/101
4,308,674 A 1/1982 Tessaro
4,377,042 A * 3/1983 Bauer ..... A43B 13/36 36/101
4,454,663 A * 6/1984 Graillat ..... A43B 5/046 36/118.2
4,499,675 A 2/1985 Perotto
4,581,832 A 4/1986 Hensler
4,611,414 A * 9/1986 Vogel ..... A43B 5/0441 280/613
4,696,117 A 9/1987 Ottieri
4,706,316 A * 11/1987 Tanzi ..... A43B 9/12 12/142 T
4,733,484 A 3/1988 Delery
4,864,743 A * 9/1989 Begey ..... A43B 5/0405 36/117.8
4,936,295 A * 6/1990 Crane ..... A61F 5/0111 36/89
4,941,271 A 7/1990 Lakie
4,959,912 A 10/1990 Kaufman et al.
4,979,319 A * 12/1990 Hayes ..... A43B 5/04 36/114
5,012,598 A * 5/1991 Baggio ..... A43B 5/0449 36/117.8
5,062,226 A * 11/1991 Sartor ..... A43B 5/0439 36/117.8
5,086,575 A 2/1992 Bonaventure
5,090,138 A 2/1992 Borden
5,113,526 A * 5/1992 Wang ..... A41D 31/245 2/2.5
5,142,798 A * 9/1992 Kaufman ..... A43B 5/047 36/117.4
5,189,815 A 3/1993 Pozzobon et al.
5,279,053 A * 1/1994 Pallatin ..... A43B 5/0409 36/10
5,323,548 A 6/1994 Vogel
5,386,650 A 2/1995 Storz
5,487,227 A * 1/1996 Marmonier ..... A43B 5/04 36/117.1
5,526,587 A * 6/1996 Sartor ..... A43B 5/0405 36/10
5,606,808 A * 3/1997 Gilliard ..... A43B 5/0401 36/100
5,692,321 A * 12/1997 Holstine ..... A43B 5/0407 36/10
5,802,741 A * 9/1998 Turner ..... A43B 5/0401 36/115
5,806,212 A * 9/1998 Benoit ..... A43B 5/0433 36/118.2
5,815,953 A 10/1998 Kaufman et al.
5,826,354 A * 10/1998 Garbujo ..... A43B 5/04 36/117.1
5,855,079 A * 1/1999 Herbert ..... A43B 3/0047 36/10
5,933,987 A * 8/1999 Demarchi ..... A43B 5/16 36/10
6,079,129 A 6/2000 Bourdeau et al.
6,082,026 A 7/2000 Sand et al.
6,226,898 B1 * 5/2001 Trimble ..... A43B 3/0047 36/10
6,243,972 B1 6/2001 De France
6,243,973 B1 * 6/2001 Lind ..... A43B 13/26 36/100
RE37,319 E 8/2001 Meiselman
6,298,584 B1 * 10/2001 Bauvois ..... A43B 5/0456 36/117.1
6,368,173 B1 4/2002 Runyan
6,453,580 B1 * 9/2002 Lancon ..... A43B 5/0411 36/117.2
6,467,192 B1 * 10/2002 Egtvedt ..... A43B 3/166 36/117.6
6,691,434 B1 2/2004 Couturier
6,792,700 B2 9/2004 Gallegos
7,231,729 B2 * 6/2007 Heierling ..... A43B 5/04 36/117.3
7,377,058 B2 * 5/2008 Elkington ..... A43B 3/0047 36/10
7,406,782 B2 8/2008 Valat et al.
7,475,501 B1 * 1/2009 DeToro ..... A43B 1/0081 36/110
7,908,774 B2 * 3/2011 Mirza ..... A43B 1/0036 36/137
8,065,820 B2 * 11/2011 Sartor ..... A43C 11/142 36/117.1
8,850,720 B2 * 10/2014 Marechal ..... A43B 5/0433 36/115
9,237,777 B2 * 1/2016 Perotto ..... A43B 3/26
9,867,423 B2 * 1/2018 Girard ..... A43B 3/18
2001/0010422 A1 8/2001 Merino et al.
2002/0088146 A1 * 7/2002 Joseph ..... A43B 5/04 36/117.3
2002/0139010 A1 * 10/2002 Hilgarth ..... A43B 5/04 36/118.2
2002/0184795 A1 * 12/2002 Kan ..... A43B 5/1633 36/115
2003/0205871 A1 * 11/2003 Coburn ..... A43B 5/1633 280/11.3
2004/0181975 A1 9/2004 Piva
2004/0200098 A1 10/2004 Martin et al.
2004/0221486 A1 * 11/2004 Dennison ..... A43B 7/18 36/31
2006/0162192 A1 * 7/2006 Roux ..... A43B 1/0072 36/118.2
2007/0175069 A1 * 8/2007 Zanatta ..... A43B 5/145 36/131
2007/0271824 A1 11/2007 Holzer et al.
2008/0000109 A1 1/2008 Challande
2008/0052962 A1 3/2008 Battilana
2008/0148602 A1 6/2008 Marechal
2008/0148603 A1 * 6/2008 Pellegrini ..... A43B 5/04 36/117.6
2008/0155862 A1 7/2008 Battlogg et al.
2008/0209768 A1 9/2008 Trinkaus et al.
2009/0000152 A1 * 1/2009 Agnew ..... A43B 5/0405 36/118.1
2009/0277045 A1 * 11/2009 Sartor ..... A43B 5/0458 36/117.2
2010/0095493 A1 * 4/2010 Chawla ..... A43B 3/122 24/662
2010/0101114 A1 4/2010 Reagan et al.
2010/0115798 A1 5/2010 Sartor et al.
2010/0229425 A1 9/2010 Parisotto
2010/0251574 A1 10/2010 Battlogg et al.
2011/0083343 A1 4/2011 Holzer et al.
2013/0118040 A1 * 5/2013 Rastello ..... A43B 3/06 36/118.2

(56) References Cited

U.S. PATENT DOCUMENTS

| | | | | |
|---|---|---|---|---|
| 2013/0167404 | A1* | 7/2013 | Kaushik | C08L 67/02 36/87 |
| 2013/0312293 | A1* | 11/2013 | Gerber | A43B 23/17 36/34 R |
| 2014/0115928 | A1* | 5/2014 | Pelletier, Jr. | A43B 5/0401 36/116 |
| 2014/0373394 | A1* | 12/2014 | Dal Bello | A43B 5/0427 36/117.1 |
| 2016/0192729 | A1* | 7/2016 | Rastello | A43B 5/0476 36/117.7 |
| 2017/0202297 | A1* | 7/2017 | Parisotto | A43B 5/0405 |
| 2017/0208892 | A1* | 7/2017 | Neiley | A43B 5/0409 |

FOREIGN PATENT DOCUMENTS

| | | | | |
|---|---|---|---|---|
| EP | 0232488 | A2 | 8/1987 | |
| EP | 0847706 | A2 | 6/1998 | |
| EP | 0948912 | A2 | 10/1999 | |
| WO | WO-8604489 | A1 * | 8/1986 | A43B 13/36 |
| WO | WO-03001937 | A1 * | 1/2003 | A43B 5/0433 |
| WO | WO-2012058451 | A1 * | 5/2012 | A43B 5/0401 |

* cited by examiner

Fig. 32A
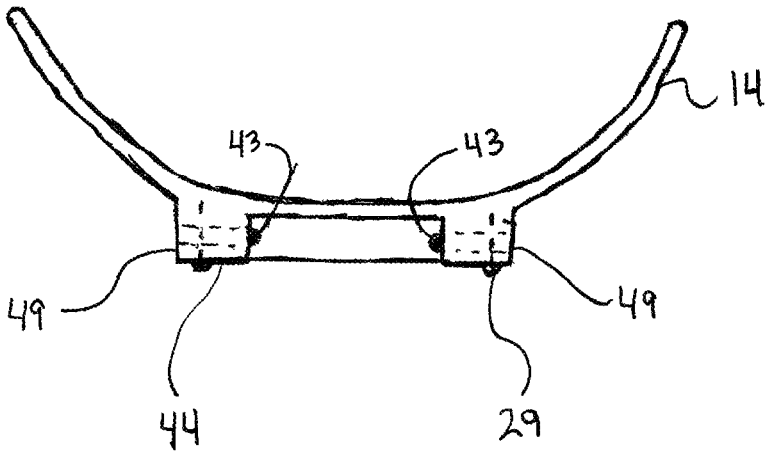
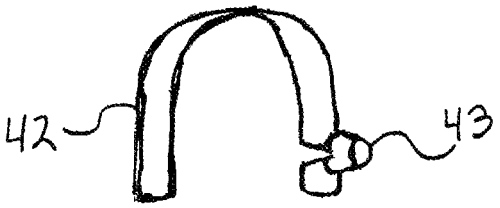
Fig. 32B

SKI BOOT ASSEMBLY

BACKGROUND

1. Field

Example embodiments relate in general to ski boots, and more specifically, to a ski boot assembly having an outer shell that accommodates an inner shoe.

2. Discussion of Related Art

Conventional ski boots include a rigid outer shell, which is typically fabricated from plastic materials. The rigid outer shell performs two basic functions. First, the outer shell anchors the foot to the ski via a ski binding. Second, the outer shell strengthens and supports the connection between the lower leg and the foot so that movements in the lower leg are transmitted efficiently to the foot and ski. A loose or sloppy fit may reduce efficiency by requiring a larger movement or greater effort to produce a given result. Accordingly, a close and tight fit is desirable.

Although existing ski boots have enjoyed widespread use, they are not without shortcomings. For example, a rigid outer shell may not conform well to the multitude of foot shapes, which makes the boots uncomfortable. Moreover, the plastic of the outer shell may stiffen in cold weather with the result that it can be difficult and even painful to remove one's foot from the boot.

Most manufacturers use an inner liner, which is a soft layer, to provide a buffer between the shell and the skier's foot. A variety of methods and materials have been devised for this buffer, but many skiers find that boots are uncomfortable, especially over an extended length of time. Some liners offer a closer fit by molding with the use of heat. But moldable liners are more expensive, and they do not solve the problem of the outer shell stiffening in cold weather. Despite these problems, the majority of commercially available boots retain the rigid outer shell.

To provide the desired connection between the lower leg and the ski, conventional designs extend the rigid outer shell above the ankle to the lower leg and employ a cuff around the shell with a pivot point at the ankle. The cuff, in combination with the outer shell, strengthens the connection between the lower leg and the ski so that skiers can put substantial pressure on the ski to achieve precise carving turns. A problem with the conventional combination of the cuff and the outer shell is that different degrees of restriction in the flex movement of the ankle are desirable for different types of skiing and different levels of ability. Usually, stiffer boots are desired by more experienced skiers. The degree of stiffness is determined primarily by the type of plastic used in the outer shell, and each model has a given degree of resistance. Usually the stiffer boots are more expensive. Even so, all models tend to stiffen in cold weather.

Conventional ski boots are also heavy and awkward to walk in. Some liners are removable from the outer shell. But the liners are not designed for walking. For example, a liner may have smooth sole to mate with the corresponding smooth inner surface of the outer shell, and this can lead to slipping.

In an attempt to increase comfort, some assemblies have been proposed in which a flexible shoe or boot is mounted to a rigid plate or outer frame. But such assemblies have resulted in unwanted relative movements between the foot and the ski. Any looseness of the foot within the walking boot or any relative movement between the walking boot and the outer frame reduces the efficiency of motion control in skiing. Looseness in the forefoot area is detrimental when skiers engage in swiveling movements in the horizontal plane (when skiing in moguls, for example). Looseness in the heel area is detrimental when the heel tends to slip up relative to the boot sole when the skier leans forward.

Conventional assemblies also fail to properly connect the lower leg to the ski. The problem of connecting the lower leg to the ski centers on movement in the ankle. Looseness in the connection between the lower leg and the foot occurs naturally because, even when the tibia is held completely still, the ankle allows the foot to move in a variety of ways. Specifically, the foot can rotate around the three axes of space passing through the ankle, the natural pivot point. The foot can rotate around the vertical axis (one can swivel one's forefoot left or right), the foot can rotate around the lateral axis (one can raise or lower one's foot), and the foot can rotate around the longitudinal axis (one can twist one's foot clockwise or counter clockwise). Ski boots help skiers achieve a competent performance by allowing some movements but restricting others. The boot should allow the natural movement about the vertical axis, limit the movement about the lateral axis in a specific manner, and prevent movement about the longitudinal axis. To provide this set of characteristics along with comfort, efficiency, and simplicity has proved difficult. This challenge has led to complicated structures. For example, some conventional structures incorporate a complex torsion spring made of rubber. Complex designs are likely to increase the cost of manufacture. There are some simpler designs. But here, levers are attached at the lower end to the heels of shoes and extend rather high on the leg to be attached to the upper calf with straps. These conventional structures create a pivot point for the lever that does not coincide with the ankle, the natural pivot of the foot. This disparity creates discomfort by pushing the strap up or down on the calf when the skier leans forward or returns to a more upright stance. The high placement of the strap up to and including the knee makes it extremely difficult to put the whole assembly on one's foot and leg when one is wearing the normal ski pants. Furthermore, in some conventional assemblies, the shoes cannot be removed from the surrounding structure in order to walk easily. In other assemblies, the shoe can be inserted and withdrawn from the outer shell. But the ease of entry comes at the cost of a substantial reduction in the resistance to forward lean. Furthermore, the design does not provide the ability to adjust the boot for skiers who may be somewhat bowlegged or knock-kneed.

SUMMARY

According to a non-limiting embodiment, a ski boot assembly may include an outer shell having a toe cap, a heel housing, and a shaft extending from the heel housing. A cuff may be attached to the heel housing of the outer shell. The cuff may extend around the shaft. The cuff may include a medial side strap that overlaps a lateral side tab. The medial side strap may be hinge coupled to the cuff. And the lateral side tab may be hinge coupled to the cuff.

According to another non-limiting embodiment, a ski boot assembly may include an outer shell with a first portion fabricated from a first material, and a second portion fabricated from a second material. The second material may be softer and more pliable than the first material. The first portion may include a sole plate supporting a toe cap, a heel housing, and a shaft extending from the heel housing. The second portion may cover an opening in the first portion, and include an instep cover, an ankle cover, and a shin cover. A cuff may be attached to the heel housing of the outer shell. The cuff may extend around the shaft and the shin cover, such that the instep cover remains exposed. A bootboard may be situated inside the outer shell and above the sole plate. The bootboard may include a transverse ridge that extends along the entire width of the bootboard, and a longitudinal ridge that extends along the entire length of the bootboard.

The above and other features, including various and novel details of construction and combinations of parts will be more particularly described with reference to the accompanying drawings. It will be understood that the details of the example embodiments are shown by way of illustration only and not as limitations of the invention. The principles and features of this invention may be employed in varied and numerous embodiments without departing from the scope of the invention.

BRIEF DESCRIPTION OF THE DRAWINGS

Non-limiting embodiments will become more fully understood from the detailed description below and the accompanying drawings, wherein like elements are represented by like reference numerals, which are given by way of illustration only and thus are not limiting of the present invention.

The figures illustrate portions of a ski boot assembly intended for the skier's left foot. It will be appreciated that the ski boot assembly for the right foot is of a similar design.

FIG. 32A is a schematic partial top view of the hard portion of the outer shell.

FIG. 32B is a perspective view of a spring loaded snap button of the ski boot assembly.

DESCRIPTION OF NON-LIMITING EMBODIMENTS

Throughout this disclosure, terms relating to spatial directions (e.g., medial, lateral, inner, outer, upper, top, lower, bottom, front, forward, rear, rearward, proximal, distal, etc.) are used for convenience in describing features or portions thereof, as shown in the figures. These terms do not, however, require that the disclosed structure be maintained in any particular orientation.

In the illustrated embodiment, the ski boot assembly includes an outer shell, a cuff mounted for limited pivot action on the outer shell, and an inner shoe that can be inserted and releaseably fixed to the outer shell. As will be discussed in more detail below, a skier wearing the ski boot assembly may disengage the inner shoe from the outer shell, and withdraw the shoe from the shell, thereby allowing the skier to walk normally and comfortably in the shoe.

Figure 1:
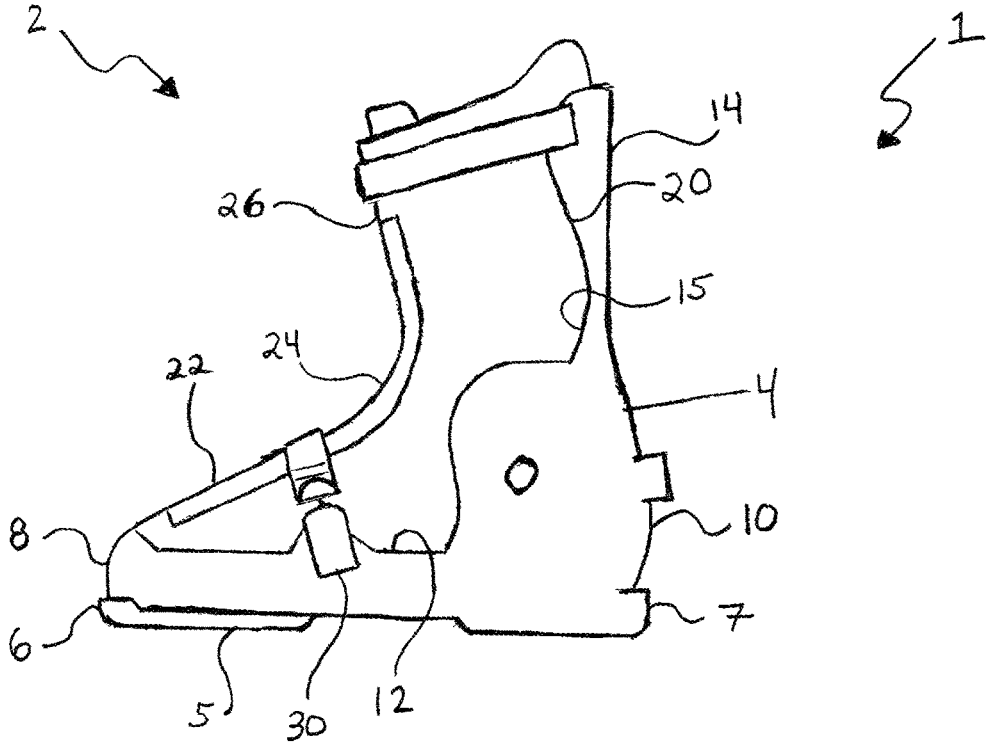
FIG. 1 is a lateral side view of an outer shell of a ski boot assembly according to a non-limiting embodiment.

The Outer Shell:

FIG. 1 illustrates the lateral (or outward facing) side of the outer shell 2 of a left ski boot assembly 1. The cuff is not shown for clarity. The outer shell 2 includes a relatively hard portion 4 and a relatively soft portion 20.

The hard portion 4 of the outer shell 2 includes a sole plate 5 having a forward lug 6 and a rearward lug 7 that interact with a conventional ski binding. A toe cap 8 is provided at the forward end of the sole plate 5, and a heel housing 10 is provided at the rearward end of the sole plate 5. The toe cap 8 and the heel housing 10 are interconnected by an intermediate portion 12. A shaft 14 extends upward from the heel housing 10 to such an extent as to cover the back of a skier's calf. The hard portion 4 (inclusive of the sole plate 5, the toe cap 8, the intermediate portion 12, the heel housing 10, and the shaft 14) may be of a unitary one-piece construction, but the invention is not limited in this regard.

The hard portion 4 includes an opening 15 superposed above the skier's instep (i.e., the arched part of the foot between the toes and the ankle), and in front of the skier's ankle and lower leg. The edge of the opening 15 is defined by the edges of the toe cap 8, the intermediate portion 12, the heel housing 10, and the shaft 14.

The soft portion 20 of the outer shell 2 covers the opening 15 in the hard portion 4. The soft portion 20 includes an instep cover 22, an ankle cover 24, and a shin cover 26. The shin cover 26 may extend all the way around the skier's leg and cover the skier's lower leg and calf above the inner shoe (not shown). Thus, a rear portion of the shin cover 26 may be interposed between the shaft 14 and the skier's leg to provide comfort and warmth. The soft portion 20 may be fixed to the hard portion 4 using screws, rivets, adhesives, hook and loop fasteners, or some other conventional fastening mechanism. By way of example only, the fastening mechanisms may be applied at locations where the soft portion 20 and the hard portion 4 overlap, for example along the shaft 14 or along the edges of the opening 15.

The hard portion 4 can be fabricated from any rigid material that is used to fabricate a conventional rigid outer shell. Such materials include, but are not limited to, thermoplastics, polyurethane, polyether, and carbon fiber composite materials. Numerous and varied rigid materials, which can be suitably implemented, are well known in this art. Of course the hard portion 4 can be fabricated from different types or densities of materials, so that different areas of the hard portion 4 can have different strengths, stiffness, flex, etc. The soft portion 20 can be fabricated from softer and more pliable materials that are used to fabricate a conventional inner liner, and which may provide thermal insulation, cushioning, and comfort. Such materials include, but are not limited to, neoprene, foamed materials, ethylene vinyl acetate, textiles, fabrics, etc. Numerous and varied soft materials, which can be suitably implemented, are well known in this art. Of course the soft portion 20 can be formed of several parts that can be glued, sewed, or otherwise assembled together. Regardless of the specific materials implemented, the soft portion 20 is softer and more pliable than the hard portion 4.

A conventional fastening device 30 may be secured to the hard portion 4 so that it extends across the opening 15 and the instep cover 22 of the soft portion 20. The fastening device 30 may include a buckle secured to the intermediate portion 12 on the lateral side of the shell 2, and an associated ridge strap secured to the intermediate portion 12 on the medial side of the shell 2. The structure and function the fastening device 30 is well known in this art.

Figure 2:
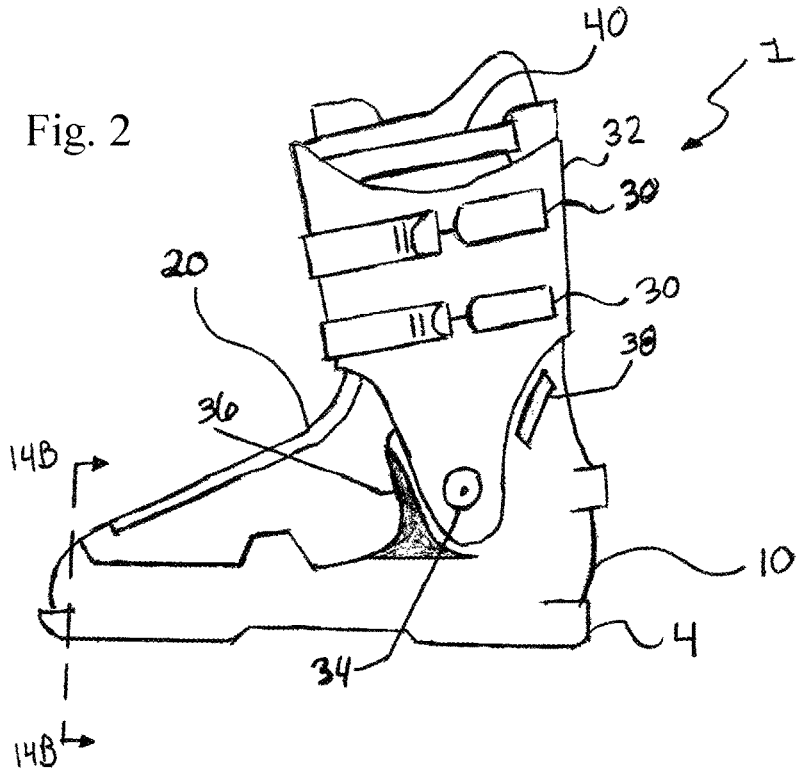
FIG. 2 is a lateral side view of the outer shell with a cuff.

FIG. 2 illustrates the lateral side of the left ski boot assembly 1, including the cuff 32 mounted for limited pivot action on the outer shell 2. The cuff 32 is attached to the heel housing 10 of the hard portion 4 using shaft alignment bolts 34. The bolts 34 also serve to change the angle of the cuff 32 to match the angle of the skier's leg. The shaft alignment bolts 34 and their functions are conventional. Two ridges 36, 38 may be provided on the heel housing 10 to limit the degree to which the cuff 32 can rotate forward and backward. As shown, the cuff 32 surrounds the shin cover 26 of the soft portion 20 and the shaft 14 of the hard portion 4. Conventional fastening devices 30 are provided to adjust the fit around a skier's lower leg.

Figure 3:
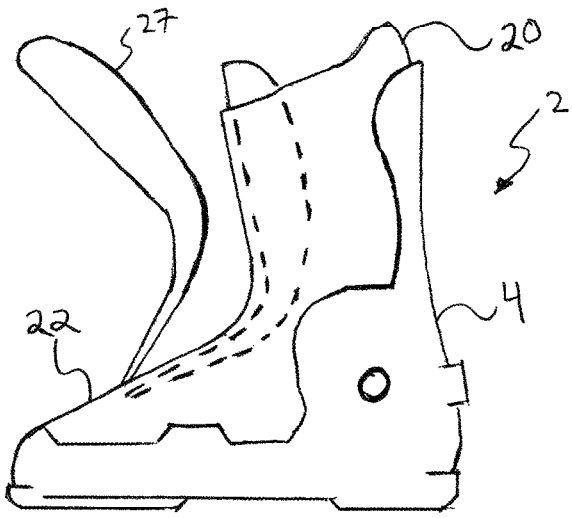
FIG. 3 is a lateral side view of the outer shell with a tongue folded outward.

As shown in FIG. 3, the soft portion 20 may include a tongue 27. The tongue 27 fills a slit provided in the soft portion 20. The slit extends between the lateral and medial sides of the outer shell 2 (see FIG. 4). The tongue 27 is secured at a lower end to the instep cover 22. Accordingly, the tongue 27 may be folded from a rearward position (shown in dashed lines) to a forward positon (shown in solid lines) to facilitate insertion/removal of the inner shoe (not shown). The pliability of the soft portion 20 also facilitates insertion/removal of the shoe.

Figure 4:
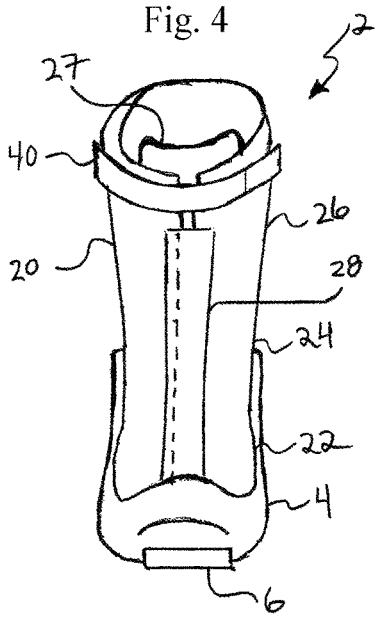
FIG. 4 is front view of the outer shell.

FIG. 4 illustrates the front of the left ski boot assembly again without the cuff. The soft portion 20 may include a strip 28 of flexible material attached (e.g., sewn as shown in dashed lines) to one side of the slit in the outer shell 2. The strip 28 covers the slit in the soft portion 20 from the outside. A strap 40 may extend around the shin cover 26 of the soft portion 20 and be secured to the shaft 14 of the hard portion 4. Turning back briefly to FIG. 2, the strap 40 is situated on the inside of the cuff 32. The strap 40 offers an adjustable closure (via a hook and loop fastener, for example) at the top of the outer shell 2, while the cuff 32 and fastening devices 30 secure the lower leg and foot within the ski boot assembly 1 with varying degrees of firmness as desired. A second strap 40 (not shown) may be added closer to the ankle.

Figure 5:
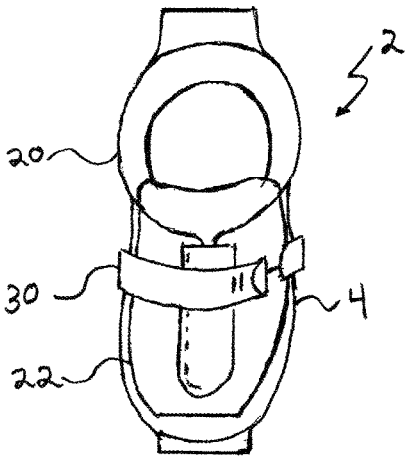
FIG. 5 is a top view of the outer shell.

As shown in FIG. 5, the fastening device 30 mounted on the outer shell 2 is fixed to the hard portion 4 and extends across the instep cover 22 of the soft portion 20.

Figure 6:
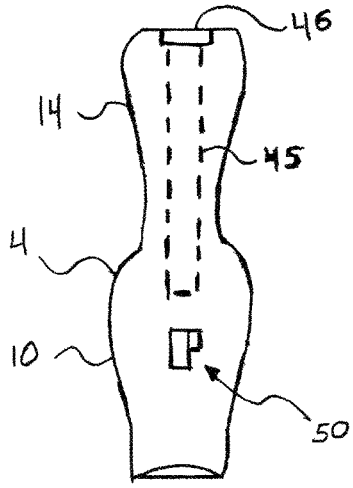
FIG. 6 is a rear view of a hard portion of the outer shell.

FIG. 6 is a rear view of the hard portion 4 of the outer shell 2. The shaft 14 may be provided with a pocket 45 (shown in broken lines) with an upward facing opening. The pocket 45 may receive a flex bar 46, which can be interchangeable. A locking mechanism 50 may be mounted on the heel housing 10 of the hard portion 4. The locking mechanism 50 may interact with the inner shoe (not shown). The locking mechanism 50 may be actuated by manipulating a lever that can be situated on the medial (or inward facing) side of the mechanism. The flex bar 46 and the locking mechanism 50 are described in more detail below.

FIGS. 7-10 illustrate hinge features provided on the cuff 32. The cuff 32, as with conventional designs, includes medial side straps that overlap a lateral side tab. And the conventional fastening devices 30 on the cuff 32 may be adjusted to achieve the desired overlap, and thus the desired fit around a skier's lower leg.

Figure 7:
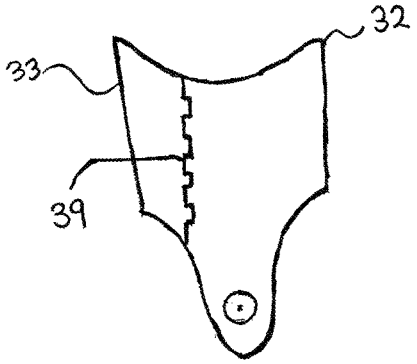
FIG. 7 is a partial lateral side view of the cuff.
Figure 8:
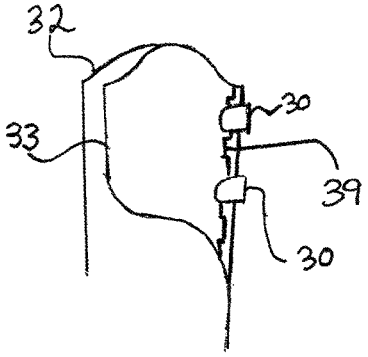
FIG. 8 is a partial front view of the cuff.

FIG. 7 illustrates the lateral (or outward facing) side of the cuff 32 of the left ski boot assembly. The medial side strap and the fastening devices 30 are omitted for clarity. The lateral side tab 33 is coupled to the cuff 32 via a hinge 39. The hinge 39 allows the lateral side tab 33 to open out and away from the tongue 27 (about a hinge pin not shown) to facilitate insertion and withdrawal of the inner shoe. The buckle of the fastening device 30 would be mounted rearward (to the right) of the hinge 39. FIG. 8 is a front view of the lateral side tab 33. The medial side of the cuff 32 is not shown because it would cover the lateral side tab 33. As shown, the buckles of the fastening devices 30 are attached to the cuff 32 behind the hinge 39 so that they do not interfere with the opening of the cuff 32.

Figure 9:
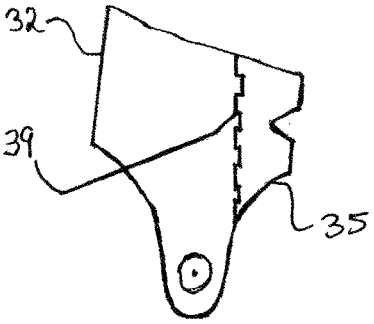
FIG. 9 is a partial medial side view of the cuff.
Figure 10:
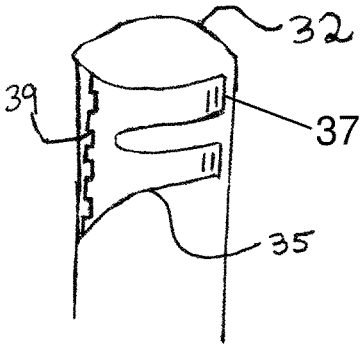
FIG. 10 is a partial front view of the cuff.

FIG. 9 illustrates the medial (or inward facing) side of the cuff 32 of the left ski boot assembly. As shown, the medial side straps 35 are coupled to the cuff 32 via a hinge 39. The hinge 39 allows the medial side straps 35 to open out and away from the tongue 27 (about a hinge pin not shown) to facilitate insertion and withdrawal of the inner shoe. FIG. 10 is a front view of the medial side straps 35, which function in a manner typical of current buckle designs. The lateral side tab 33 is not shown for clarity. As with conventional designs, the medial side straps 35 support the ridge straps 37 of the fastening devices 30. Of course the medial side straps 35 and the ridge straps 37 may be of an integral, one-piece construction.

When the fastening devices 30 are released (i.e., the buckles are disengaged from the ridge straps 37), the medial side straps 35 and the lateral side tab 33 may be rotated outward about the corresponding hinges 39 to expose the tongue 27 of the soft portion 20. In this way, the cuff 32 can be opened without the significant elastic deformation required by conventional designs. The tongue 27 can then be moved to the forward positon shown in FIG. 3 so that the inner shoe can be inserted into or withdrawn from the outer shell 2 with ease. Numerous and varied conventional hinges can be suitably implemented.

The Inner Shoe:

The shoe 70 fits inside the outer shell 2 of the ski boot assembly. The upper of the shoe 70 may be fabricated from materials that provide both warmth and enough tensile strength to allow the skier to tighten the fit to his or her own preference. Such materials are well known in this art. The tightness of the shoe 70 may be controlled by shoestrings designed with smooth plastic eyelets that disperse the tightness along the length of the shoe 70. This may reduce the development of pressure points. It will be appreciated that alternative arrangements for the shoe closure are possible. The shoelaces could extend around the top of the heel counter, as in some climbing shoes, and/or a strap could extend from the heel counter over the instep. The shoe 70 may fit well at the heel but allow the toes to move freely. The sole of the shoe 70 may be fabricated from dense materials similar to that of rock climbing shoes rather than the more compressible materials of many running shoes. The shoe 70 may have several features that fix it to the foundation supporting the shoe. The typical foundation is in the form of a bootboard provided in the outer shell 2, but the invention is not limited in this regard. These features may prevent the shoe 70 from moving in any of the three dimensions relative to the bootboard.

Figure 11:
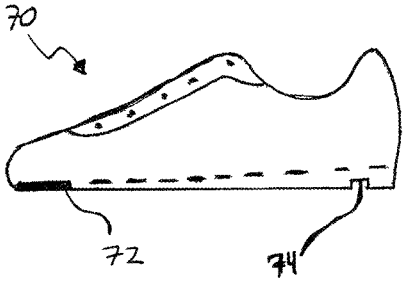
FIG. 11 is a lateral side view of an inner shoe of the ski boot assembly.

FIG. 11 illustrates the lateral (or outward facing) side of the left inner shoe 70. A set of flanges 72 is provided at the toe of the shoe 70. A transverse groove 74 extends across the sole of the shoe 70 near the heel. When the shoe 70 is in place, the transverse groove 74 will fit over a transverse ridge in the bootboard and prevent the shoe 70 from moving forward or backward relative to the bootboard. The transverse groove 74 is placed near the heel so that it will not hinder the shoe 70 from slipping in and out of the outer shell 2. This is because the heel is the last part of the shoe 70 to be lowered into the outer shell 2 and the first part to be lifted out of the outer shell 2.

Figure 12:
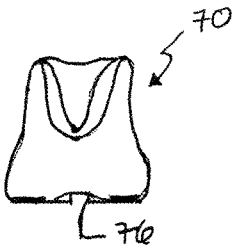
FIG. 12 is a front view of the shoe.

Turning to FIG. 12, a longitudinal groove 76 is provided in the sole that extends across the length of the shoe. The longitudinal groove 76 is also shown in FIG. 11 in broken lines. When the shoe 70 is in place, the longitudinal groove 76 fits over a longitudinal ridge in the bootboard and prevents the shoe 70 from moving left or right relative to the bootboard. This feature may improve the skier's ability to steer the skis, because movements of the foot will be translated directly to the ski boot assembly 1 and the ski.

Figure 13:
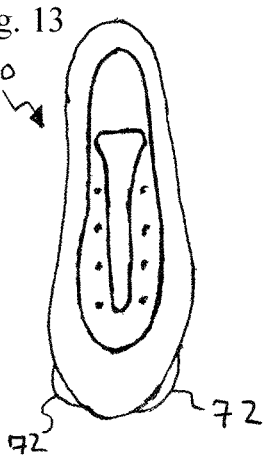
FIG. 13 is a top view of the shoe.

As shown in FIG. 13, the flanges 72 extend out from each side of the toe of the shoe 70. These flanges 72 fit into slots provided on the inside of the hard portion 4 of the outer shell 2. When the shoe is placed in the outer shell 2, the flanges 72 engage with the slots and prevent the toe of the shoe 70 from moving up and away from the bootboard. The instep fastening device 30 (see FIGS. 1 and 5) will also keep the shoe 70 from moving relative to the bootboard, and pressure from the fastening device 30 can be adjusted to suit the comfort of the skier. The fastening device does not have to be uncomfortably tight because the flanges 72 and the heel locking mechanism 50 provide stability.

Figure 14A:
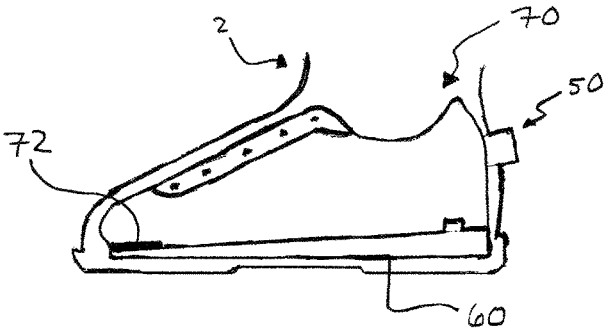
FIG. 14A is schematic lateral side view of the shoe inserted into the outer shell.
Figure 14B:
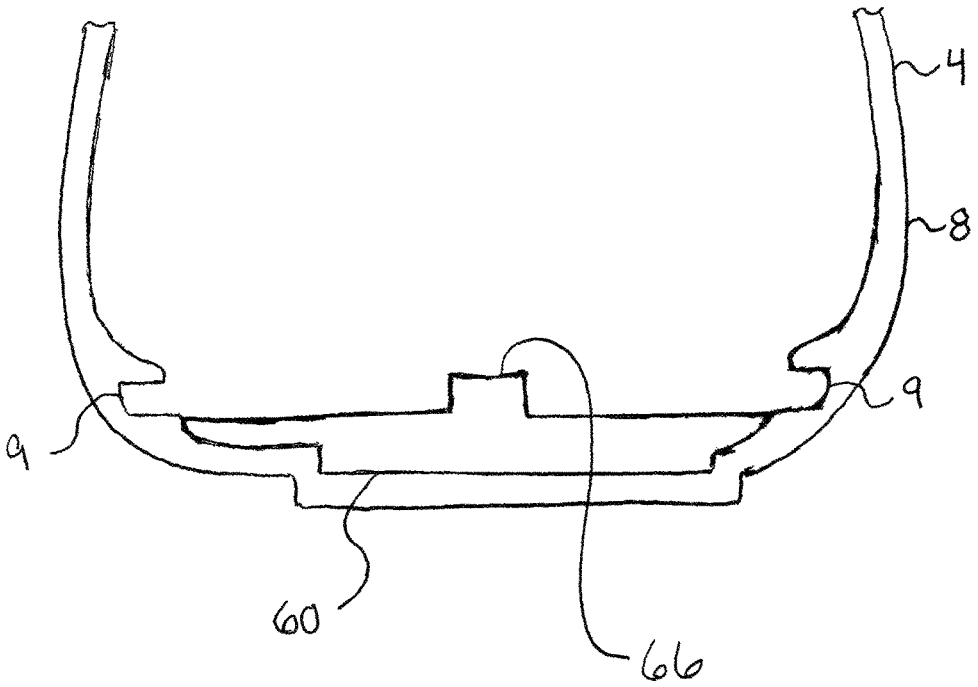
FIG. 14B is a cross-sectional view taken along the line 14B-14B of FIG. 2.

FIG. 14A illustrates the shoe 70 inserted into the outer shell 2. The shoe 70 rests on the bootboard 60, which itself fits tightly into the hard portion 4 of the outer shell 2. The bootboard 60 serves to keep the shoe 70 rigid relative to the outer shell 2 and also provides some heel lift so the heel is higher than the toe. Providing heel lift is a conventional feature that may help adjust a skier's center of gravity. FIG. 14B illustrates the slots 9 that receive the toe flanges 72 of the shoe 70 (not shown). The slots 9 are provided on the interior of the toe cap 8, and situated just above the bootboard 60. Additional structural details of the bootboard 60 will be discussed more thoroughly with reference to FIGS. 23-25 below.

FIG. 14A also illustrates the locking mechanism 50 that keeps the heel of the shoe 70 from lifting up and away from the bootboard 60. The locking mechanism 50, the flanges 72, and the grooves 74, 76 in combination with the bootboard 60 keep the shoe 70 and foot of the skier tightly connected to the bottom of the outer shell 2 and the ski. These features avoid the conventional need for a hard plastic shell over the entire instep to perform that function, and they perform it more effectively and comfortably.

The Locking Mechanism:

The locking mechanism 50 may be fabricated from metal, plastic, or other conventional materials that are well known in this art. Structural and functional details of the locking mechanism 50 will be appreciated with reference to FIGS. 15-18.

Figure 15:
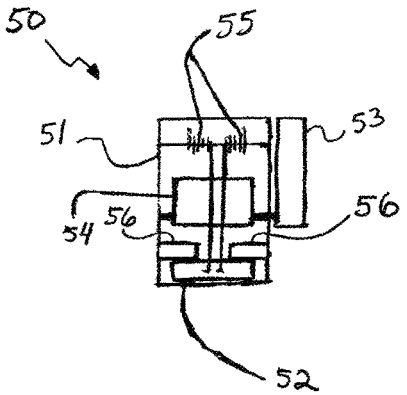
FIG. 15 is a rear view of a locking mechanism of the ski boot assembly in a locked condition.
Figure 16:
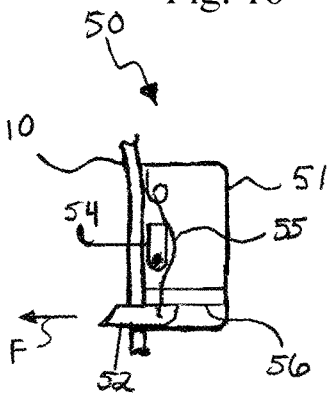
FIG. 16 is a lateral side view of the locking mechanism in the locked condition.

FIGS. 15 and 16 illustrate the locking mechanism 50 in a locked condition. The locking mechanism 50 includes a housing 51 attached to the heel housing 10 of the outer shell 2. A first lever 53 is mounted on the exterior of the housing 51, and a second lever 54 is mounted on the interior of the housing 51. As shown in FIG. 15, the first and the second levers 53, 54 are fixed to a pin that is mounted for rotation relative to the housing 51. And therefore, the first and the second levers 53, 54 are rotatable together relative to the housing 51 about an axis of the pin. A spring mechanism 55 has one end fixed to the housing 51, and the other end fixed to the lock bar 52. An intermediate portion of the spring mechanism 55 extends across and abuts against the inside lever 54. The spring mechanism 55 influences the lock bar 52 in a forward direction (arrow F) and into the interior of the heel housing 10, as shown in FIG. 16. The spring mechanism 55 may be in the form of one or more torsion springs having coils, but the invention is not limited in this regard.

The outside lever 53 controls the rotational position of the inside lever 54. The inside lever 54, in turn, controls the movement of the spring mechanism 55 and the lock bar 52. In FIGS. 15 and 16, the distal end of the exterior lever 53 has been rotated upward to actuate the locking mechanism 50. The distal end of the interior lever 54 is also rotated upward and positioned against the base of the housing 51. In this condition, the spring mechanism 55 pushes the lock bar 52 in the forward direction (arrow F) and through a space defined by the sides of the housing 51 and two posts 56 that extend from the base of the housing 51. The posts 56 are spaced apart to allow movement of the spring mechanism 55 in the forward direction (arrow F).

In FIG. 16, the exterior lever 53 is hidden from view. The spring mechanism 55 elastically presses against the interior lever 54. Accordingly, when the interior lever 54 is positioned against the base of the housing 51 (as shown), the spring mechanism 55 pushes the lock bar forward (arrow F) and into the interior of the heel housing 10. The extended lock bar 52 engages with the shoe 70 (not shown) so that it cannot be withdrawn from the outer shell 2, as described below in FIG. 22.

Figure 17:
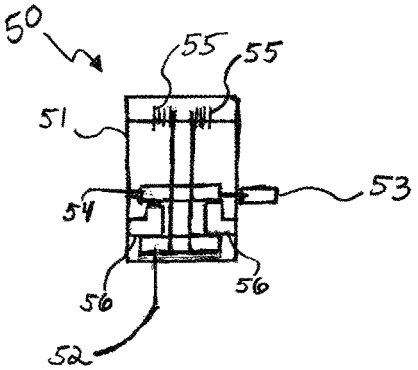
FIG. 17 is a rear view of the locking mechanism in an unlocked condition.
Figure 18:
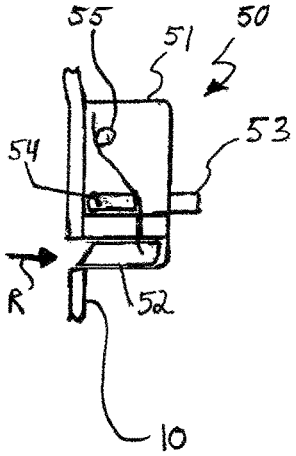
FIG. 18 is a lateral side view of the locking mechanism in an unlocked condition.

FIGS. 17 and 18 illustrate the locking mechanism 50 in an unlocked condition. As shown in FIG. 17, the posts 56 can be L-shaped to keep the interior lever 54 from moving past the perpendicular position. The L-shapes of the posts 56 are not shown in FIGS. 15 and 16 for clarity. In the unlocked condition, both the exterior and the interior levers 53, 54 are rotated and positioned perpendicular to the base of the housing 51. That is, as compared to the condition shown in FIGS. 15 and 16, the distal ends of the levers 53, 54 are positioned further away from the heel housing 10 of the outer shell 2.

With reference to FIG. 18, as the interior lever 54 rotates, it pushes the spring mechanism 55 and thus the lock bar 52 in a rearward direction (arrow R) and away from the base of the housing 51. The lock bar 52 is removed from the interior of the heel housing 10 and wholly contained within the housing 51. If the levers 53, 54 are rotated back to the positions shown in FIGS. 15 and 16, the spring mechanism 55 will elastically influence the lock bar 52 in the forward direction (arrow F) and into the interior of the outer shell 2.

Figure 19:
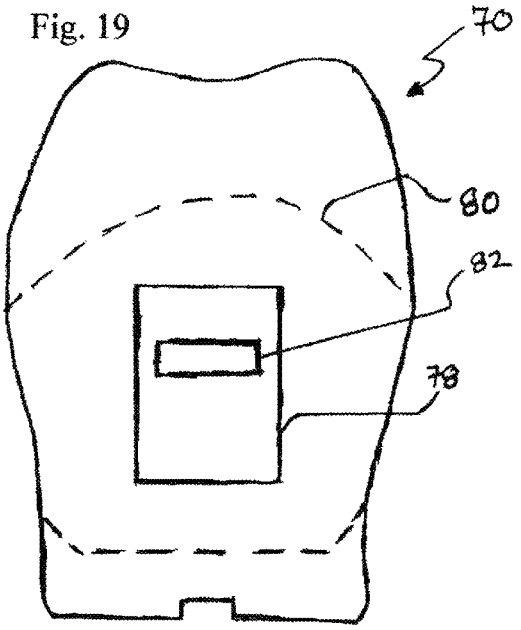
FIG. 19 is a rear view of the shoe.

The locking mechanism 50 may interact with features provided on the inner shoe 70 as shown in FIGS. 19-22. With reference to FIG. 19, a plate 78 may be embedded in the heel counter 80 (shown in broken lines) of the shoe 70. The plate 78 is provided with a blind recess 82 for receiving the lock bar 52 of the locking mechanism 50. The heel counter 80 should be rigid (as most are) so that the plate 78 does not flex toward the toe of the shoe 70 and move away from the lock bar 52 when the shoe 70 is inserted into the outer shell 2. The shoe 70 cannot move toward the toe of the outer shell 2 due to the interaction between the transverse groove 74 of the shoe 70 and the transverse ridge of the bootboard 60, which will be more fully described with reference to FIG. 23. Outer material may cover the heel counter 80 as in most conventional shoes. But in this case, the plate 78 and the blind recess are left exposed.

Figure 20:
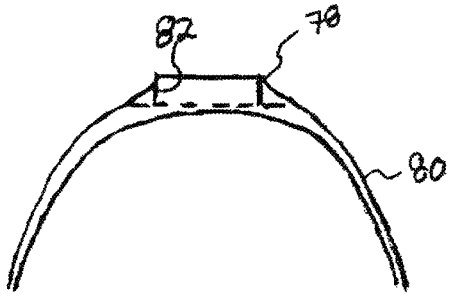
FIG. 20 is a partial top view of the shoe.
Figure 21:
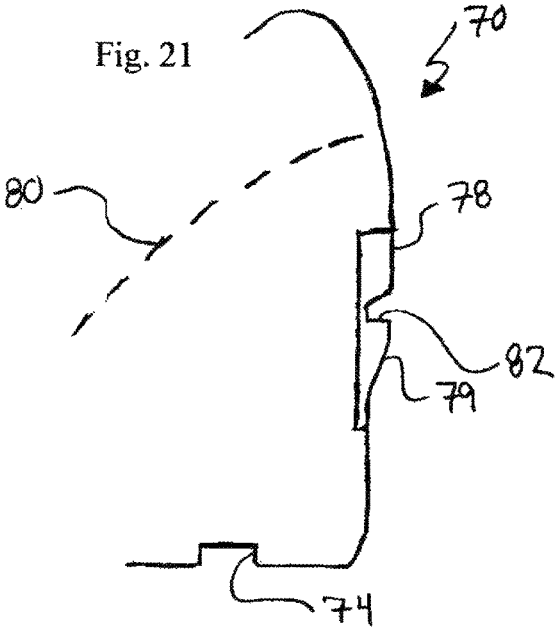
FIG. 21 is a partial lateral side view of the shoe.

As shown in the top view of FIG. 20, the heel counter 80 is thicker at the very back of the heel to accommodate the plate 78. And in FIG. 21, the side portion of the plate 78 that would normally block the view of the blind recess 82 is not shown for clarity. The plate 78 includes a ramped surface 79 leading up to the blind recess 82.

Figure 22:
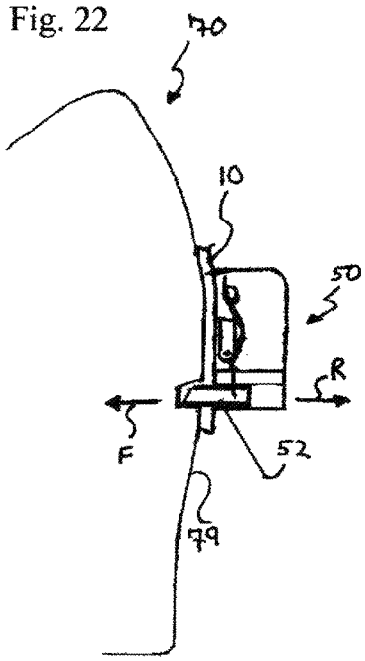
FIG. 22 is a partial lateral side view of the shoe engaged with the locking mechanism.

FIG. 22 illustrates how the lock bar 52 engages with the blind recess 82 in the shoe 70 when the locking mechanism 50 is in the locked condition. The ramped surface 79 of the plate 78 and the shape of lock bar 52 allow the shoe 70 to be inserted into the outer shell 2 even when the locking mechanism 50 is in the locked condition. Here, the ramped surface 79 of the plate 78 would engage with the inclined forward facing surface of the lock bar 52. As the shoe 70 is inserted, the ramped surface 79 would slide across and push the lock bar 52 in the rearward direction (arrow R) and against the influence of the spring mechanism 55. Once the ramped surface 79 passes beyond the lock bar 52, the spring mechanism 55 would influence the lock bar 52 in the forward direction (arrow F) and into the blind recess 82. This feature offers the skier the convenience that he or she can always insert the shoe 70 into the outer shell 2 regardless of the condition of the locking mechanism 50. However, when the lock bar 52 is in the locked position, the shoe 70 cannot be lifted out of the inner shell 2 because of the engagement between the lock bar 52 the blind recess 82. The locking mechanism 50 must be in the unlocked condition (as shown in FIGS. 17 and 18) to withdraw the shoe 70. The blind recess 82 and the lock bar 52 should be made of durable and machined parts, because they will endure considerable pressure during use, especially by expert skiers.

Figure 23:
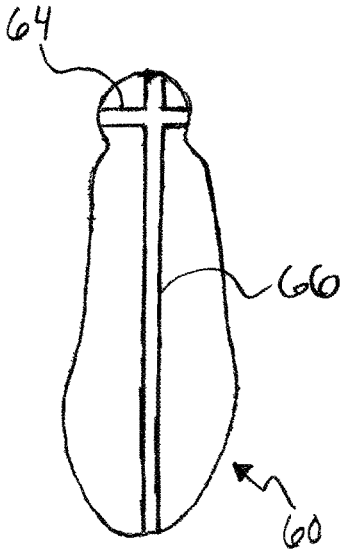
FIG. 23 is a top view of a bootboard of the ski boot assembly.

The Bootboard:

With reference to FIG. 23, the bootboard 60 has an upward facing surface provided with a pair of ridges 64, 66. A transverse ridge 64 extends across the heel of the bootboard 60. And a longitudinal ridge 66 extends along the length of the bootboard 60 from heel to toe. The ridges 64, 66 respectively fit into the grooves 74, 76 provided in the shoe 70 and prevent the shoe 70 from moving forward/backward or left/right relative to the bootboard 60. The bootboard 60 fits securely into the outer shell 2 (above the sole plate 5) so that it cannot move laterally or forward/backward relative to the outer shell 2. The bootboard 60 is also captured between the inner shoe 70 and the sole plate 5 of the outer shell 2, as shown in FIG. 14, so that it cannot move away from the sole plate 5 when the shoe 70 is inserted and the locking mechanism 50 actuated. The bootboard 60 may have indentations near the heel to provide a means of grabbing the bootboard to withdraw it from the outer shell 2.

Figure 24:
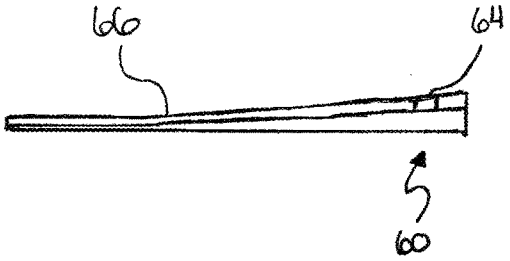
FIG. 24 is a lateral side view of the bootboard.

As shown in the side view of FIG. 24, the thickness of the bootboard 60 may drop by half an inch from the heel to the toe. As shown, the ridges 64, 66 maintain their size at all points on the bootboard 60. But the invention is not limited in this regard. For example, the ridges 64, 66 may have a varied height along their respective lengths. This may be advantageous for example to correspond to the contour of the sole of the shoe 70. The ridges 64, 66 (as well as the grooves 74, 76) may be intermittently provided. The cross sectional shape of the ridges 64, 66 (as well as the cross sectional shape of the grooves 74, 76 provided in the shoe 70) may be varied, so long as the interaction between the ridges 64, 66 and the groves 74, 76 prevent the relative movements discussed above with respect to FIGS. 11 and 12.

Figure 25:
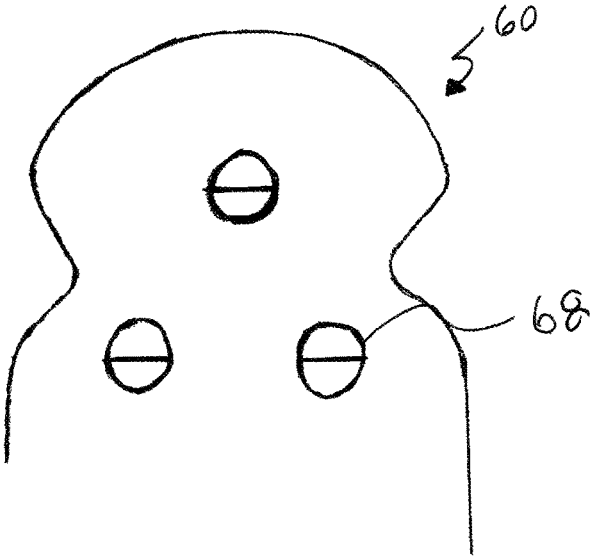
FIG. 25 is a partial bottom view of the bootboard.

As shown in FIG. 25, one or more screws 68 can be screw coupled to threaded bores provided in the bottom of the bootboard 60. The length of the screws 68 may be less than the thickness of the bootboard 60. And the shafts of the screws 68 may be of the same diameter as the heads. The screws 68 can be turned to raise/lower the heel of the bootboard 60 should adjustments be needed to allow full entry of the lock bar 52 into the blind recess 82. For example, if a screw 68 is rotated to advance it downward and raise the heel of the bootboard 60, the head of the screw 68 will advance toward and abut against the underlying sole plate 5. Further rotation of the screw 68 will elevate the heel of the bootboard 60 away from the sole plate 5. It will be appreciated that the head of the screw 68 may be withdrawn into the threaded bore in the bootboard 60.

Figure 26:
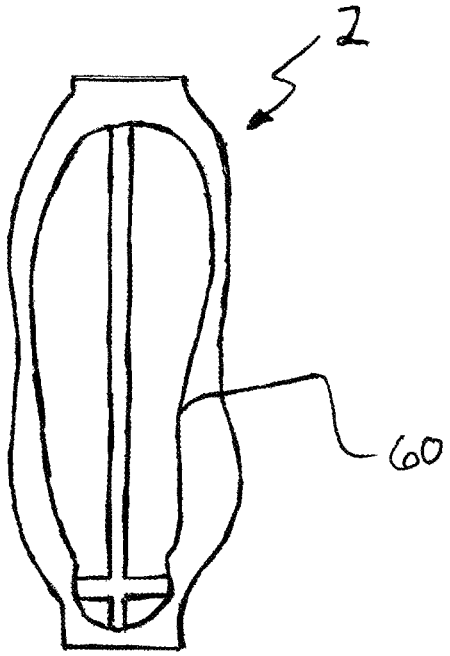
FIG. 26 is a schematic top view of the bootboard inserted into the outer shell.
Figure 27:
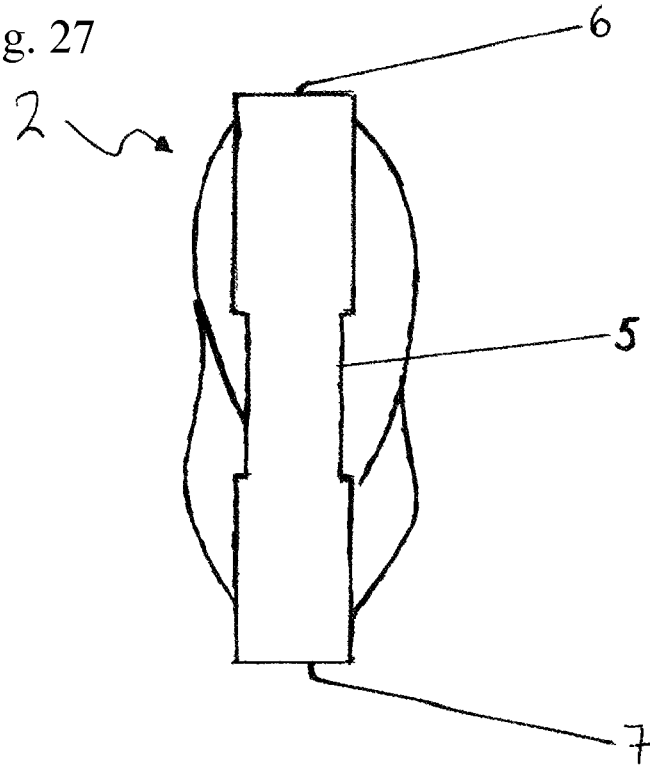
FIG. 27 is a bottom view of the outer shell.

FIG. 26 illustrates the position of the bootboard 60 within the outer shell 2, and above the sole plate 5. And FIG. 27 illustrates the bottom of the outer shell 2. As shown, the sole plate 5 includes the forward lug 6 at the toe and the rearward lug 7 at the heel. The lugs 6, 7, which interact with a conventional ski binding, meet industry standards for size and shape.

Figure 28A:
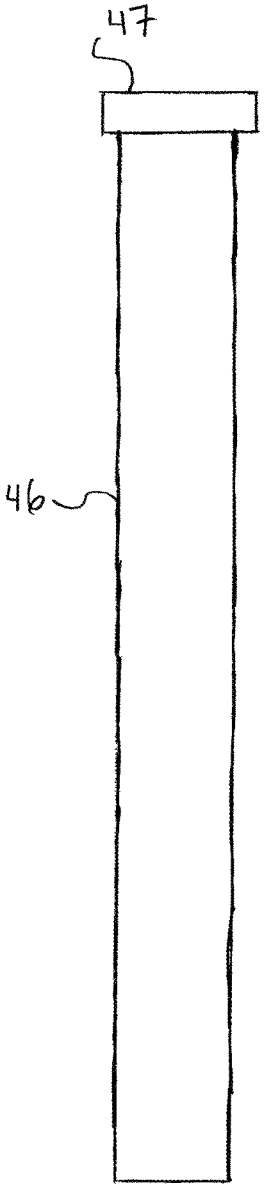
FIG. 28A is a rear view of a flex bar of the ski boot assembly.
Figure 28B:
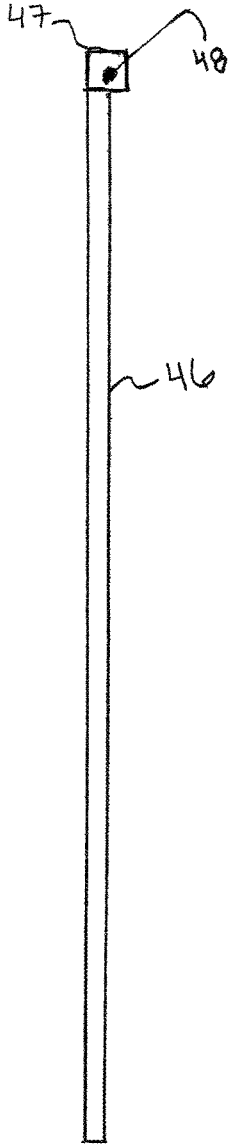
FIG. 28B is a lateral side view of the flex bar.
Figure 28C:
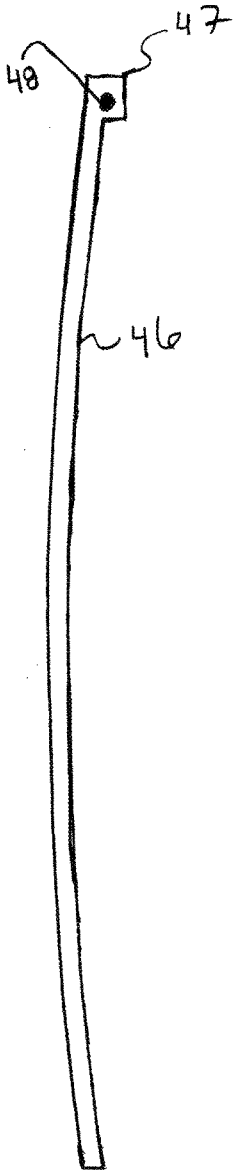
FIG. 28C is a lateral side view of a flex bar according to an alternative embodiment.

The Flex Bar:

FIGS. 28A, B, and C illustrate details of the flex bar 46. The top 47 of the flex bar 46 is enlarged on three sides, with the exception being the broad side closest to the calf of the skier (i.e., the left side in FIGS. 28B and C). FIG. 28A illustrates the outward facing broadside of the flex bar 46. And FIGS. 28B and C illustrate the lateral side of the flex bar 46. The enlarged top 47 is provided with depressions 48 for receiving a snap button (not shown) to hold the flex bar 46 in place after it is inserted into the shaft 14. FIGS. 28A and B illustrate an embodiment in which the flex bar 46 has a straight longitudinal axis. FIG. 28C illustrates an alternative in which the flex bar 46 has a curvature built in. This curvature should follow a circle so that the flex bar 46 can be inserted and withdrawn easily from a similarly curved shaft 14. The curved flex bar 46 may have the advantage that it more closely follows the shape of the skier's calf, but it may also complicate manufacturing.

The flex bar 46, which may function as a leaf spring, allows variations in flexibility. Resistance to forward lean allows skiers to lean forward without falling in order to put pressure on the tips of their skis. But variations in flexibility are desirable. For example, beginning skiers may benefit from more flexible boots, while experienced skiers often want stiffer boots. The flex bar 46 can be fabricated from steel, a steel alloy, or other material that does not lose its flexibility in lower temperatures. The flex bars 46 can be interchanged to provide different degrees of flexibility, without the need to buy another pair of boots. With this design, skiers can even change the flexibility of their boots on the slope.

Figure 29:
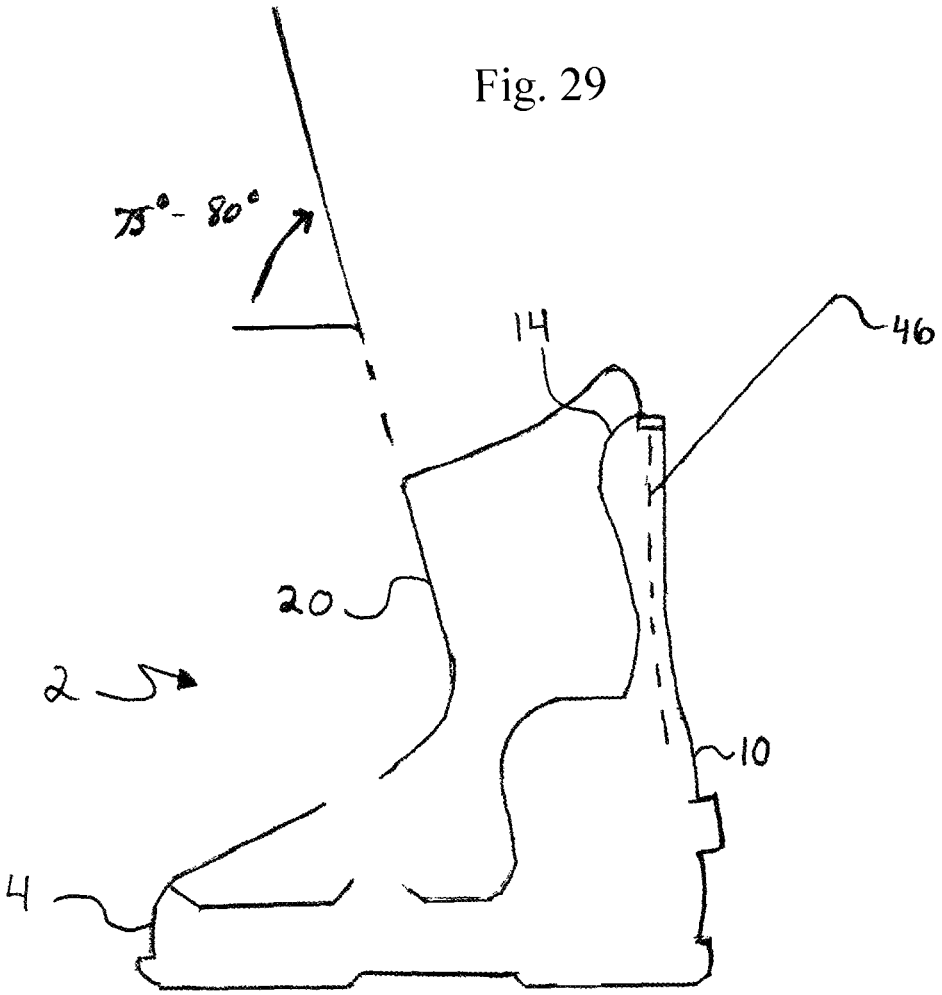
FIG. 29 is a schematic lateral side view of the outer shell.

FIG. 29 illustrates the placement of the flex bar 46 (shown in broken lines) within the pocket 45 provided in the hard portion 4 of the outer shell 2. The flex bar 46 may be inserted into the shaft 14 from the top. The shaft 14 may be thin enough to bend with the flex bar 46. The flex bar 46 provides most of the resistance to the forward pressure from the skier. The distal end of the flex bar 46 may enter into the heel housing 10 of the hard portion 4. By way of example only, the flex bar 46 may enter into the heel housing 10 by about an inch. But the invention is not limited in this regard. The heel housing 10 is thick enough to be very rigid. In this way, the heel housing 10 may act as a clamp on the distal end of flex bar 46 so that only the upper part of the flex bar 46 can flex. The angle of the shaft 14 in combination with the shape of the cuff (not shown) determine the forward lean of the shell 2 and the cuff (between 75 and 80 degrees) at the point where they cover the skier's shin. It will be appreciated that the boot assembly can be manufactured with different degrees of forward lean built in.

Figure 30:
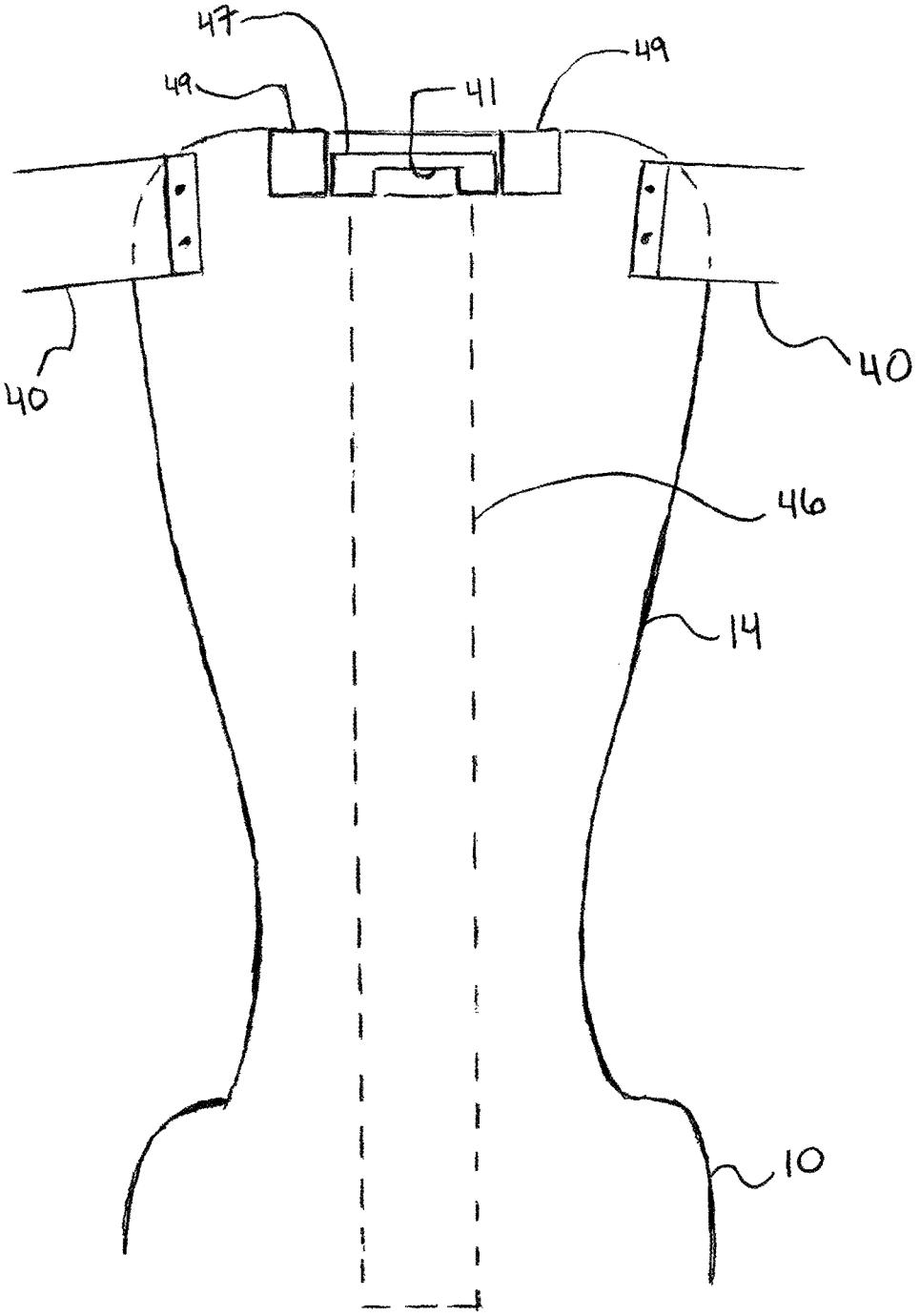
FIG. 30 is a schematic partial rear view of the hard portion of the outer shell.

As shown in FIG. 30, the top of the shaft 14 supports a box 49 situated on each side of the top 47 of the flex bar 46. Each box 49 houses a spring loaded snap button (not shown). The snap buttons are elastically biased to enter into the depressions 48 of the top 47 to hold the flex bar 46 in place until the skier pulls the flex bar 46 up with sufficient force to depress the snap button against the influence of the spring so that the snap button is withdrawn from the corresponding depression 48. After that, the flex bar 46 can be withdrawn from the shaft 14 easily. The top 47 may include a cutout 41 that allows the skier to grasp the flex bar 46 in order to pull it out of the shaft 14. FIG. 30 also illustrates the strap 40 attached to the top of the shaft 14. The strap 40 is used to tighten the outer shell 2 around the calf. Ends of the strap 40 may be attached to the shaft 14 with rivets. As noted with reference to FIG. 4, the strap 40 wraps around the shin cover 26 of the outer shell 2 to provide an efficient clasp of the calf. The strap 40 is situated on the inside of the cuff (not shown).

Figure 31A:
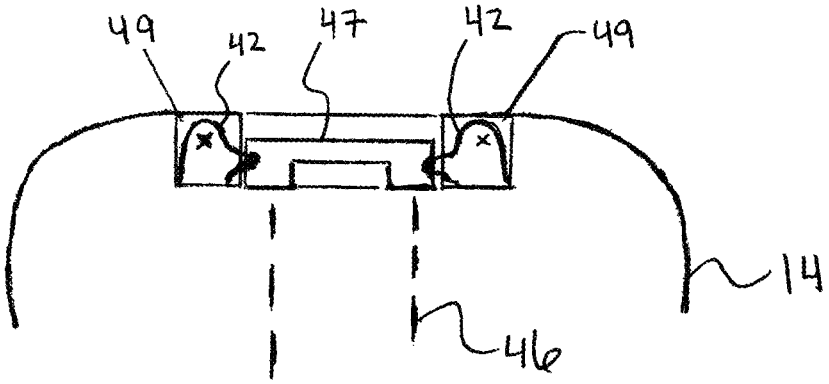
FIG. 31A is a schematic partial rear view of the hard portion of the outer shell.
Figure 31B:
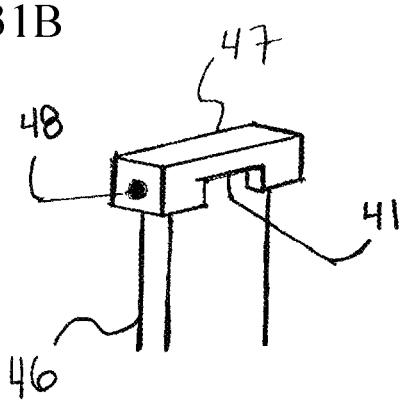
FIG. 31B is a partial perspective view of the flex bar.

FIG. 31A illustrates the snap buttons (not labeled) and the springs 42 that are mounted in the boxes 49 on both sides of the flex bar 46. The boxes 49 may be manufactured as part of the shaft 14 except for cover plates (not shown). The cover plates may be removable to allow access to insert the snap buttons and springs 42. The cover plates can be attached by means of screws at the locations indicated by the x's in FIG. 31. FIG. 31B more clearly illustrates the location of the cutout 41, which allows the skier to grip the flex bar 46 to withdraw it from the shaft 14.

FIG. 32A is a top view of the shaft 14, with the flex bar 46 removed. As shown, the snap buttons 43 pass through inward facing openings in the boxes 49 so that they may enter into the depressions 48 in the flex bar 46 when it is in place. FIG. 32A also illustrates the cover plates 44 and the screws 29 that fix the cover plates 44 to the boxes 49. FIG. 32B is an enlarged view of the spring 42 and the snap button 43 that are mounted in each of the boxes 49.

Additional Alternative Embodiments

FIGS. 33-36 illustrate an alternative locking mechanism 50'. The locking mechanism 50' is similar to the one depicted in FIGS. 15-18, except that the spring mechanism is in the form of a folded metal spring 55', which is elastically deflectable similar to the spring in a binder clip.

Figure 33:
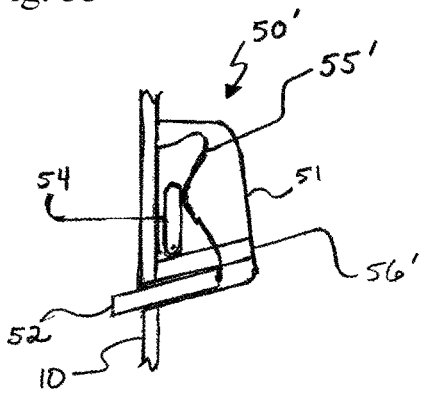
FIG. 33 is a medial side view of an alternative locking mechanism in the locked condition.

In FIG. 33, the locking mechanism 51' is shown in the locked condition, in which the interior lever 54 has been rotated upward so that its distal end is positioned against the base of the housing 51. The spring 55' can be a piece of folded metal. One end of the spring 55' is attached to the lock bar 52, and the other end is attached to the housing 51. The two ends of the spring 55' are urged to close toward each other. As a result, the spring 55' elastically retains the interior lever 54 in the position shown in FIG. 33, such that the lock bar 52 is in the locked position. The exterior lever 53 is not shown for clarity. The posts 56' in this embodiment are similar to those shown in FIG. 15-18, but here they are slanted downward toward the heel housing 10. The lock bar 52 is also slanted downward via its engagement with the posts 56' and the housing 51. The slanted lock bar 52 will more securely retain the shoe 70 in the locked position.

Figure 34:
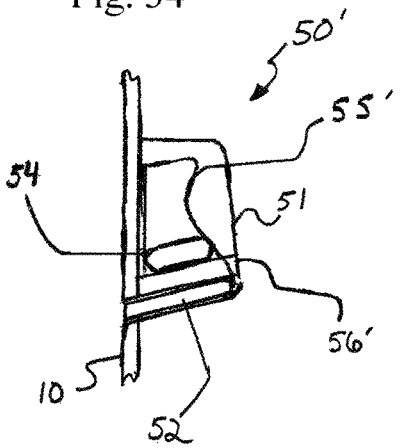
FIG. 34 is a medial side view of the alternative locking mechanism in the unlocked condition.

In FIG. 34, the locking mechanism 50' is shown in the unlocked condition, in which the interior lever 54 is rotated such that its distal end is positioned away from the heel housing 10. As the interior lever 54 is rotated to the condition shown in FIG. 34, it pushes the spring 55' and the lock bar 52 in a rearward direction and unlocks the locking mechanism 50'. The shape of the intermediate portion of the spring 55' will retain the interior lever 54 in the position shown in FIG. 34. The lock bar 52 may have a forward facing surface that is flush with the heel housing 10 as shown. Alternatively, the lock bar 52 may have an inclined forward facing surface similar to the one depicted in FIGS. 16 and 18.

Figure 35:
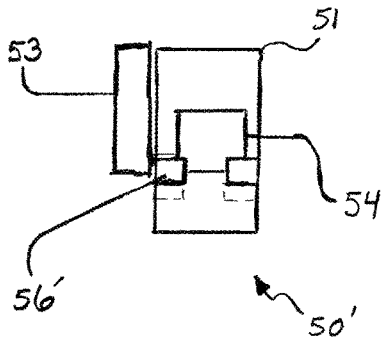
FIG. 35 is a partial rear view of the alternative locking mechanism in the locked condition.

FIG. 35 illustrates the locking mechanism 50' in the locked condition. The spring mechanism 55' and the locking bar 52 are not shown for clarity. The exterior and the interior levers 53, 54 are shown in the locked position. A lower portion of the interior lever 54 is hidden behind the posts 56' due to the inclined orientation of the posts 56'.

Figure 36:
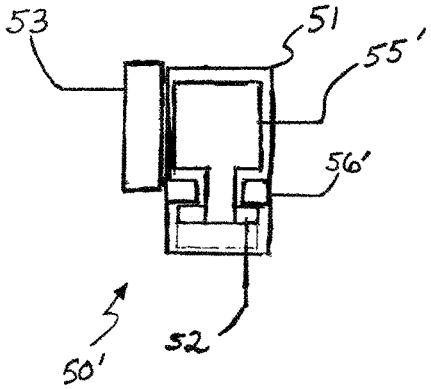
FIG. 36 is a rear view of the alternative locking mechanism in the locked condition.

FIG. 36 also shows the locking mechanism 50' in the locked condition. Here, however, the spring 55' and the lock bar 52 are also illustrated.

Although the foregoing description is directed to preferred embodiments of the present teachings, it is noted that other variations and modifications will be apparent to those skilled in the art, and which may be made without departing from the spirit or scope of the present teachings.

The foregoing detailed description of the various embodiments of the present teachings has been provided for the purposes of illustration and description. It is not intended to be exhaustive or to limit the present teachings to the precise embodiments disclosed. Many modifications and variations will be apparent to practitioners skilled in this art. The embodiments were chosen and described in order to explain the principles of the present teachings and their practical application, thereby enabling others skilled in the art to understand the present teachings for various embodiments and with various modifications as are suited to the particular use contemplated. It is intended that the scope of the present teachings be defined by the following claims and their equivalents.

What is claimed is:

1. A ski boot assembly comprising:

an outer shell having a toe cap, a heel housing, and a shaft extending from the heel housing;

a cuff attached to the heel housing of the outer shell, the cuff extending around the shaft, the cuff including a medial side strap, a middle portion, and a lateral side tab;

wherein the medial side strap overlaps the lateral side tab;

wherein the medial side strap is hinge coupled to the middle portion via a first hinge;

wherein the lateral side tab is hinge coupled to the middle portion via a second hinge; and wherein the first hinge is provided on a medial side of the cuff, and the second hinge is provided on a lateral side of the cuff;

a fastening device that includes a buckle mounted on the cuff and located rearward of the lateral side tab, and a ridge strap mounted on the medial side strap;

wherein the buckle and the ridge strap are engageable to adjust the amount of overlap between the medial side strap and the lateral side tab.

2. The ski boot assembly according to claim 1, further comprising:

a pocket provided in the outer shell and having an opening in a distal end of the shaft; and a flex bar inserted through the opening and into the pocket;

wherein the cuff extends around the flex bar.

3. The ski boot assembly according to claim 2, wherein the flex bar extends through the shaft and into the heel housing.

4. The ski boot assembly according to claim 2, wherein the flex bar is fabricated from metal.

5. The ski boot assembly according to claim 2, further comprising:

a pair of spring loaded snaps mounted on the shaft on opposed sides of the opening, the spring loaded snaps being engaged with corresponding depressions in the flex bar to releasably retain the flex bar in the pocket.

6. The ski boot assembly according to claim 1, further comprising:

a calf strap fixed to the shaft and situated on an inside of the cuff.

7. The ski boot assembly according to claim 1, further comprising:

a shoe having a sole supporting a toe portion and a heel portion, the shoe being inserted into the outer shell, such that the toe portion is received by the toe cap and the heel portion is received by the heel housing;

wherein the sole of the shoe is provided with a transverse groove and a longitudinal groove that are perpendicular to each other; and wherein the outer shell includes a foundation supporting the shoe, the foundation including a transverse ridge and a longitudinal ridge respectively inserted into the transverse groove and the longitudinal groove of the sole.

8. The ski boot assembly according to claim 7, wherein the longitudinal groove extends across an entire length of the sole.

9. The ski boot assembly according to claim 7, further comprising:

a flange extending from the toe portion of the shoe;

wherein the flange is received by a slot provided on the interior of the toe cap of the outer shell.

10. The ski boot assembly according to claim 7, wherein the foundation is a bootboard interposed between the sole of the shoe and the outer shell.

11. A ski boot assembly comprising:

an outer shell having a toe cap, a heel housing, and a shaft extending from the heel housing;

a cuff attached to the heel housing of the outer shell, the cuff extending around the shaft, the cuff including a medial side strap, a middle portion, and a lateral side tab;

wherein the medial side strap overlaps the lateral side tab;

wherein the medial side strap is hinge coupled to the middle portion;

wherein the lateral side tab is hinge coupled to the middle portion;

a shoe having a sole supporting a toe portion and a heel portion, the shoe being inserted into the outer shell, such that the toe portion is received by the toe cap and the heel portion is received by the heel housing;

wherein the sole of the shoe is provided with a transverse groove and a longitudinal groove that are perpendicular to each other;

wherein the outer shell includes a foundation supporting the shoe, the foundation including a transverse ridge and a longitudinal ridge respectively inserted into the transverse groove and the longitudinal groove of the sole;

a blind recess provided in the heel portion of the shoe; and a locking mechanism mounted on the heel housing, the locking mechanism including a housing, a lock bar mounted in the housing for movement between (1) a locked position in which the lock bar is extended through an opening in the heel housing and inserted into the blind recess in the heel portion of the shoe, and (2) an unlocked position in which the lock bar is removed from the blind recess in the heel portion of the shoe, a spring influencing the lock bar toward the locked position, and a lever mounted for rotation on the housing for moving the spring away from the heel housing.

12. The ski boot assembly according to claim 11, wherein the spring is a torsion spring with coils.

13. The ski boot assembly according to claim 11, wherein the spring is a folded metal spring.

14. A ski boot assembly comprising:

an outer shell including a first portion and a second portion;

wherein the first portion includes a sole plate supporting a toe cap, a heel housing, and a shaft extending from the heel housing;

wherein each of the sole plate, the toe cap, the heel housing, and the shaft is fabricated from a first material;

wherein the second portion covers an opening in the first portion, and includes an instep cover, an ankle cover, and a shin cover;

wherein each of the instep cover, the ankle cover, and the shin cover is fabricated from a second material that is softer and more pliable than the first material;

a cuff attached to the heel housing of the outer shell, the cuff extending around the shaft and the shin cover, such that the instep cover remains exposed;

a bootboard situated inside the outer shell and above the sole plate;

wherein the bootboard includes a transverse ridge that extends in a width direction of the bootboard, and a longitudinal ridge that extends in a length direction of the bootboard;

a pocket provided in the outer shell and having an opening in a distal end of the shaft;

a flex bar inserted through the opening and into the pocket;

wherein the cuff extends around the flex bar;

a pair of spring loaded snaps mounted on the shaft on opposed sides of the opening, the spring loaded snaps being engaged with corresponding depressions in the flex bar to releasably retain the flex bar in the pocket.

15. The ski boot assembly according to claim 14, further comprising:

a shoe having a sole supporting a toe portion and a heel portion, the shoe being inserted into the outer shell, such that the toe portion is received by the toe cap and the heel portion is received by the heel housing;

wherein the sole of the shoe is provided with a transverse groove and a longitudinal groove that are perpendicular to each other; and wherein the transvers groove and the longitudinal groove of the sole respectively receive the transverse ridge and the longitudinal ridge of the bootboard.

16. The ski boot assembly according to claim 14, wherein the transverse ridge extends along an entire width of the bootboard; and wherein the longitudinal ridge extends along an entire length of the bootboard.

17. A ski boot assembly comprising:

an outer shell having a toe cap, a heel housing, and a shaft extending from the heel housing;

a cuff attached to the heel housing and extending around the shaft, the cuff including a medial side strap, a middle portion, and a lateral side tab;

wherein the medial side strap overlaps the lateral side tab;

wherein the medial side strap is hinge coupled to the middle portion via a first hinge;

wherein the lateral side tab is hinge coupled to the middle portion via a second hinge; and wherein the first hinge is provided on a medial side of the cuff, and the second hinge is provided on a lateral side of the cuff;

a fastening device that includes a buckle mounted on the cuff and located rearward of the lateral side tab, and a ridge strap mounted on the medial side strap;

wherein the buckle and the ridge strap are engageable to adjust the amount of overlap between the medial side strap and the lateral side tab a shoe having a sole supporting a toe portion and a heel portion, the shoe being insertable into the outer shell, such that the toe portion is received by the toe cap and the heel portion is received by the heel housing;

wherein an uppermost edge of the shoe terminates below an uppermost edge of the heel housing when the shoe is inserted into the outer shell.

* * * * *